US005322139A

United States Patent [19]

Rose et al.

[11] Patent Number: 5,322,139

[45] Date of Patent: Jun. 21, 1994

[54] LOOSE CROWN UNDERREAMER APPARATUS

[76] Inventors: James K. Rose; Curtis E. Rose, both of P.O. Box 507, Cedarville, Calif. 96104

[21] Appl. No.: 99,031

[22] Filed: Jul. 28, 1993

[51] Int. Cl.[5] ..... E21B 10/36; E21B 10/62

[52] U.S. Cl. ..... 175/414; 173/132; 175/415; 175/320

[58] Field of Search ..... 175/414, 320, 415, 417, 175/418, 321; 285/318; 403/326, 278, 282; 173/132

[56] References Cited

U.S. PATENT DOCUMENTS

| | | | |
|---|---|---|---|
| 1,922,559 | 8/1933 | Strobel | 175/417 |
| 2,022,055 | 11/1935 | Sanderson | 175/414 |
| 2,039,494 | 5/1936 | Sanderson | 175/414 |
| 3,709,306 | 1/1973 | Curington | 173/132 |
| 3,791,463 | 2/1974 | Pearson | 403/282 X |
| 4,043,409 | 8/1977 | Walter | 175/321 |
| 4,083,415 | 4/1978 | Kita et al. | 175/415 X |
| 4,919,221 | 4/1990 | Pascale | 175/415 |

FOREIGN PATENT DOCUMENTS

| | | | |
|---|---|---|---|
| 254229 | 2/1988 | Fed. Rep. of Germany | 175/414 |
| 1488426 | 6/1989 | U.S.S.R. | 175/414 |
| 2127463 | 4/1984 | United Kingdom | 175/415 |

OTHER PUBLICATIONS

*Halco DTH Drill Bits*-Trade Brochure; Jan. 1990.
*Halco DTH Hammers*-Trade Brochure; Jun. 1992.

*Primary Examiner*—Hoang C. Dang
*Attorney, Agent, or Firm*—John P. O'Banion; John Costello

[57] ABSTRACT

A loose crown underreamer apparatus (10) for boring into earth and other materials includes a crown (28) loosely coupled to a bit shank (12). The loose coupling mechanism (34) employed in the present invention reduces the occurrence of friction welds occurring between crown (28) and bit shank (12). Coupling mechanism (34) employed in the present invention includes a plurality of deformable polyurethane retainer balls (36) disposed in shank sockets (38) and corresponding crown sockets (40). Coupling mechanism (34) employed in the present invention allows for crown (28) to be uncoupled and re-coupled to bit shank (12) at will.

16 Claims, 6 Drawing Sheets

LOOSE CROWN UNDERREAMER APPARATUS

BACKGROUND OF THE INVENTION

Field of the Invention

This invention pertains to earth boring generally, and more particularly to a crown-type underreamer drill bit having a crown which can be easily detached from the bit shank when drilling is complete.

Description of the Background Art

Earth boring has been a convenient method for obtaining underground resources for a number of years, and additionally has utility in creating tunnels for transporting water or other materials through mountains and other geologic obstacles. Typically, for deep earth boring through unstable materials such as broken rock or cobble, it is desirable to maintain the structural integrity of the bore hole by placing lengths of pipe-like drill casing into the bore hole and coupling the lengths together. As the bore hole depth is increased, additional lengths of drill casing are added.

A typical earth boring apparatus includes a drill bit, a pneumatic drill hammer coupled to the top of the drill bit by a "chuck nut", and a drill shaft extending from the top of the drill hammer to the drill rig above the ground. The function of the drill shaft is to rotate the drill bit and hammer. The hammer contains a pneumatic piston which contacts the head of the drill bit up to 25 times per second, thus creating a shattering vibration at the point which the drill bit contacts the strata. Therefore, the drill bit bores into the earth through the dual rotation/vibration action of the boring apparatus. Hence, in order to reach a preferred bore hole depth, it is desirable that the drill bit continue to rotate and penetrate the earth until the desired depth is reached. If the boring apparatus stops rotating at any time during the drilling operation, a risk exists that the drill bit will become stuck and the drill bit, drill hammer and bore hole will subsequently have to be abandoned at great expense.

A common device for boring is a standard drill bit. The standard drill bit has a bit shank for coupling to a drill hammer, and a cutting face for boring through the strata. The bit shank and cutting face of the standard drill bit are machined or forged from a unitary piece of material.

When boring with a standard drill bit, the operator will bore directly into the earth without using a drill casing. When the desired depth is reached, the operator will remove the standard drill bit and drive numerous sections of drill casing down the bore hole. For this reason, the cutting face of the standard drill bit used for a particular boring operation is always of a greater circumference than the anticipated drill casing so that the drill casing can be easily driven into the bore hole.

A high frequency of cave-ins occurring from the lack of use of a drill casing during the initial boring operation represents a major disadvantage with the standard drill bit. When the standard drill bit is withdrawn from the bore hole, it naturally scrapes the sides of the bore hole during its vertical ascent, thereby dislodging earth and rock. A more serious potential for cave-ins results when the drill casing is subsequently driven into the bore hole. Hence, cave-ins generally always occur to varying degrees when a standard drill bit is used. In the least severe cases, the earth and debris can be cleared from the bottom of the drill casing, by pumping out the debris with the well pump. In other cases, cave-ins can be so severe that the drill casing cannot be driven into the bore hole, and the bore hole must be abandoned at great expense.

Apart from situations where cave-ins result in using the standard drill bit, heavy expense is additionally incurred in the everyday use of the standard drill bit. A standard drill bit has an average useful life of 1200 drilling feet and once this limit has been reached, the standard drill bit must be replaced. One standard drill bit can cost several thousands of dollars and therefore, must be expensed upon wearing out. While the standard drill bit is a reasonably effective drilling tool, it can readily be seen that even normal use results in high expense to the user.

Another device commonly used is an eccentric underreamer which is essentially a drill bit having an upper and a lower cutting face. The lower cutting face is known as the underreamer and is offset from the center of the upper cutting face such that it overlaps the upper cutting face upon rotation of the entire apparatus. This overlap of the underreamer causes it to overlap the circumference of the drill casing, thus cutting a wide swath to allow space for the drill casing to enter in its downward path. The advantage of using an eccentric underreamer lies in that unlike the standard drill bit, this device can be used in conjunction with a drill casing, thus avoiding cave-ins since the bore hole is continually lined with drill casing during the entire boring operation. The underreamer protrudes below the drill casing and expands outward beyond the drill casing to ream a hole of adequate circumference for accepting the drill casing which follows behind the underreamer. Additionally, a drive shoe welded to the endmost section of drill casing provides a rigid ledge inside the drill casing upon which the eccentric underreamer can apply significant force, thus carrying the entire casing and boring apparatus ever downward.

A disadvantage with the eccentric underreamer lies in the propensity of the overlap portion of the under reamer to snag upon hard rock and subsequently become permanently stuck. As a result of its propensity to become stuck, numerous bore holes have to be abandoned, resulting in great expense when the eccentric underreamer and drill hammer likewise must be abandoned. The separate losses of the eccentric underreamer and the drill hammer represent several thousands of dollars apiece, and the loss of both items together is quite prohibitive.

In an attempt to overcome the foregoing disadvantages of the standard drill bit and the eccentric underreamer, it is also common to employ a crown bit device comprising a bit shank coupled to a removable cutting surface known as the "crown". The crown is essentially an end cap having a cutting surface on its exposed face, which is pressed onto the end of the bit shank. When assembled, the crown bit apparatus is similar in appearance and function to the standard drill bit discussed previously. The principle behind the crown bit apparatus is to provide a device which can be used with a drill casing during a boring operation, wherein once the desired bore hole depth is reached, a low-expense crown can be detached and abandoned at the bottom of the hole below the drill casing. At the same time, the high-expense bit shank and drill hammer can be salvaged, thus avoiding both the cave-in problems and the high dollar loss inherent with the standard drill bit and the eccentric underreamer.

However, while the crown bit apparatus was a viable idea in theory, practice has shown that current versions of the crown bit apparatus pose significant drawbacks. The primary drawback with current crown bit devices lies in the means for coupling the crown to the bit shank which have characteristically been of a "tight engagement" press fit coupling means. In order to remove the crown, the drill shaft is withdrawn to place pressure between the crown and the end of the drill casing. Exertion of force in this manner should serve to separate the crown from the bit shank. However, the tight fit between the crown and the bit shank results in a high occurrence of friction welding occurring between the bit shank and crown. Friction welds occur as a result of atomic attraction between the tight fitting bit shank and crown which is exacerbated by the extreme pressures and high frequency vibrations caused by normal boring operations. A point is reached when the atomic attraction becomes so great that the materials comprising the bit shank and crown effectively weld together. As a result of a friction weld occurring, it is impossible to remove the crown from the bit shank by normal means, often making it necessary to abandon the crown, bit shank and the drill hammer, resulting in the same high expense discussed previously.

Attempts to alleviate the friction welding problem have come mainly in the form of varying the types of steel used in the bit shank and crown. By using dissimilar steels it was hoped that atomic attraction would be reduced, and when normal drilling pressure and vibration were applied, the resulting friction welds would be minimal or nonexistent. This solution has proven to lessen the friction weld problem, but not to an extent which results in a significant advantage over using a standard drill bit or eccentric underreamer.

Therefore, a need still exists for a crown bit-type apparatus which can be used to bore holes where drill casing can be placed as the holes are drilled, and which provides for easy separation of the bit shank from the crown when drilling is complete. The present invention satisfies this need as well as overcomes the deficiencies of prior devices and drilling techniques.

The foregoing discussion reflects the state of the art of which the applicant is aware and is tendered with the view toward discharging applicant's acknowledged duty of candor in disclosing information which may be pertinent in the examination of this application. It is respectfully stipulated, however, that none of the discussed approaches to earth boring teach or render obvious, singly or when considered in combination, applicant's claimed invention.

SUMMARY OF THE INVENTION

The present invention pertains generally to a crown bit apparatus which overcomes the friction weld problem of prior devices, and which provides for significant savings and flexibility over the previous standard drill bit and eccentric underreamer devices.

By way of example and not of limitation, the apparatus of the present invention employs a crown which is detachably coupled to a bit shank. In the preferred embodiment, both the crown and the bit shank have cutting surfaces. The crown is configured to slide over the bit shank and be coupled thereto using a plurality of resilient polyurethane retainer balls which seat in recesses or indentations provided in the mating surfaces of both the crown and the bit shank. The retainer balls are deformed during installation or removal of the crown, but return to their normal shape thereafter. As a result, the retainer balls secure the crown to the bit shank until sufficient force is applied to pull the crown away from the bit shank and cause the retainer balls to deform. Rotational motion between the crown and bit shank is avoided by the use of slots on the crown which mate with splines in the bit shank. The mating of the slots and splines also provides for alignment of the crown and bit shank for proper seating of the retainer balls.

The retainer balls provide for the crown to be uncoupled and re-coupled to the bit shank at will. Furthermore, sufficient air space exists between the bit shank and the crown to avoid significant atomic attraction, thus avoiding friction welds. Should the present invention become stuck, or should the desired drill depth be reached, the user merely has to pull upward on the boring apparatus, which forces the crown against a drive shoe attached to the drill casing (or the casing itself if a drive shoe is not used), thereby disengaging the crown from the bit shank. The low-cost crown is subsequently left at the bottom of the hole and the high-cost bit shank and drill hammer can be retrieved.

An object of the invention is to provide a loose crown underreamer apparatus which employs a detachable crown.

Another object of the invention is to provide a loose crown underreamer apparatus wherein the crown will not become friction welded to the bit shank.

Another object of the invention is to provide a loose crown underreamer apparatus which employs a loose crown design.

Another object of the invention is to provide a loose crown underreamer apparatus wherein upon reaching the desired depth, allows the drill bit and drill hammer to be readily salvaged with minimal loss expense.

Another object of the invention is to provide a crown bit apparatus having a loose crown design wherein the means for coupling the crown to the bit shank is capable of withstanding the significant pressures and vibrations caused by normal earth boring operations.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
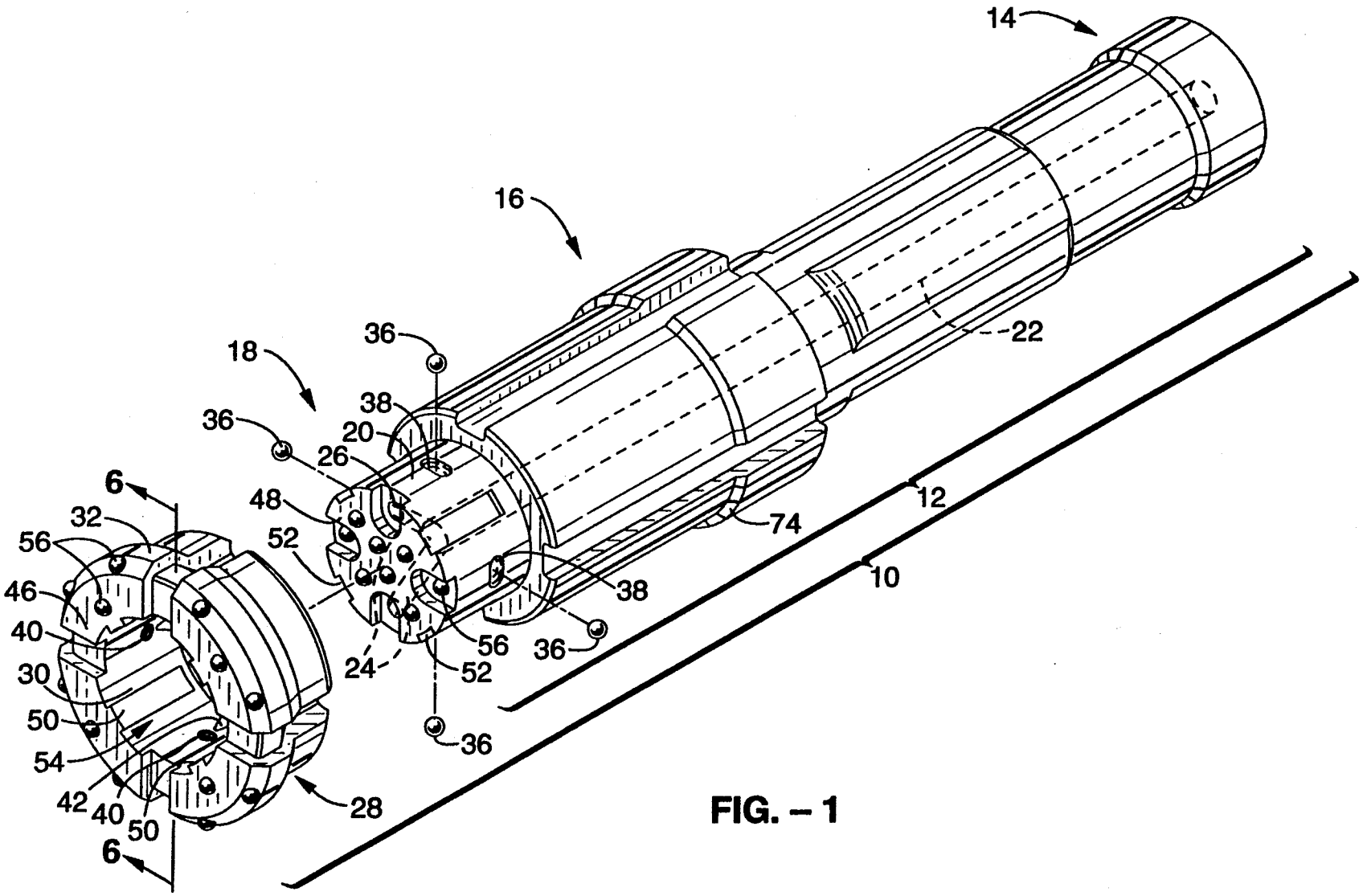
FIG. 1 is an exploded perspective view of the apparatus of the present invention.

Referring more specifically to the drawings, for illustrative purposes the present invention is embodied in the loose crown underreamer apparatus 10 generally shown in FIG. 1. It will be appreciated that the loose crown underreamer apparatus 10 may vary as to configuration and as to details of the parts without departing from the basic concepts as disclosed herein.

Figure 6:
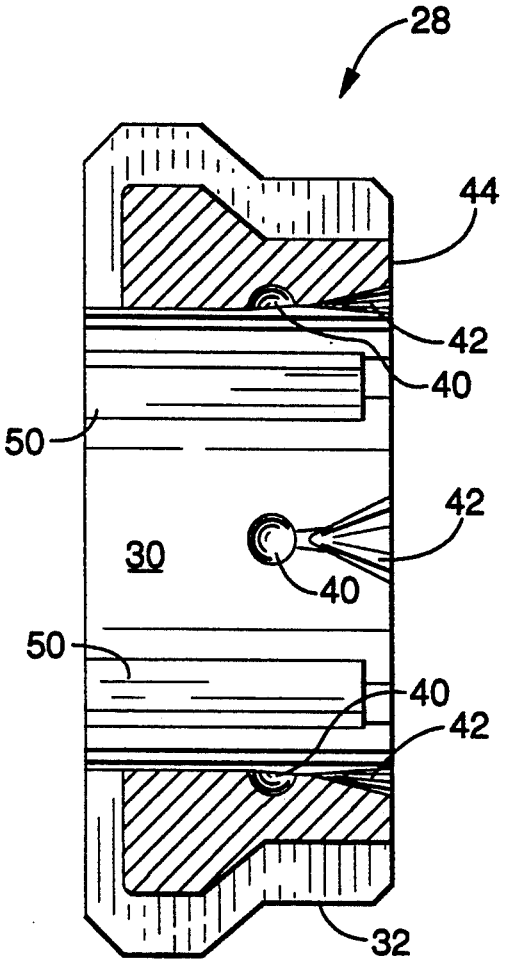
FIG. 6 is a cross sectional view of the crown portion of the apparatus of FIG. 1 taken through line 6—6.
Figure 8:
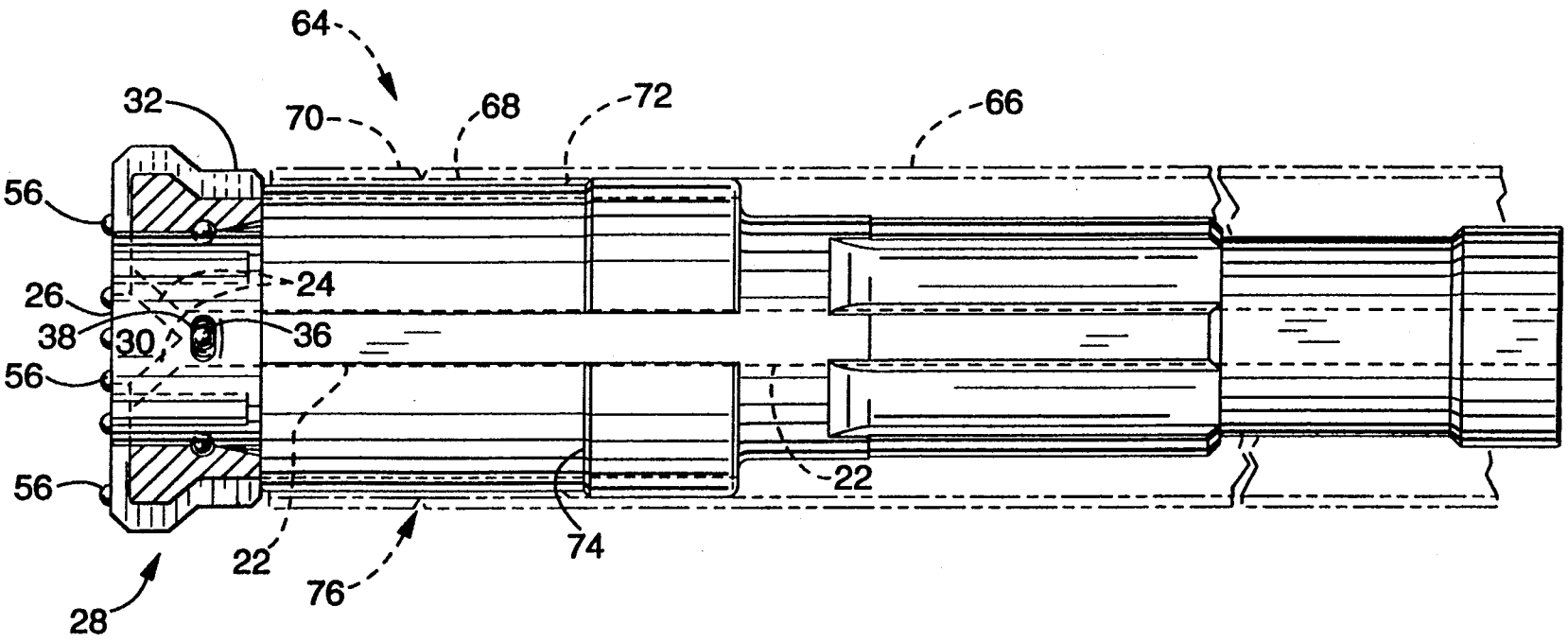
FIG. 8 is a cross sectional view of the apparatus of FIG. 7 taken through line 8—8.

Referring to FIG. 1, FIG. 6 and FIG. 8, the loose crown underreamer apparatus 10 of the present invention includes a bit shank 12 having a first end 14, a middle portion 16 and a second end 18. Additionally, second end 18 has exterior surface 20. Located in an axial relation between first end 14 and second end 18 is air shaft 22. At second end 18, air shaft 22 preferably divides into a plurality of air shaft branches 24 which terminate at a plurality of air shaft branch openings 26. First end 14 of bit shank 12 preferably has a splined configuration for coupling with the "chuck nut" portion of a drill hammer. Second end 18 of bit shank 12 couples detachably with crown 28 which preferably has an inside surface 30 and an outside surface 32.

Figure 2:
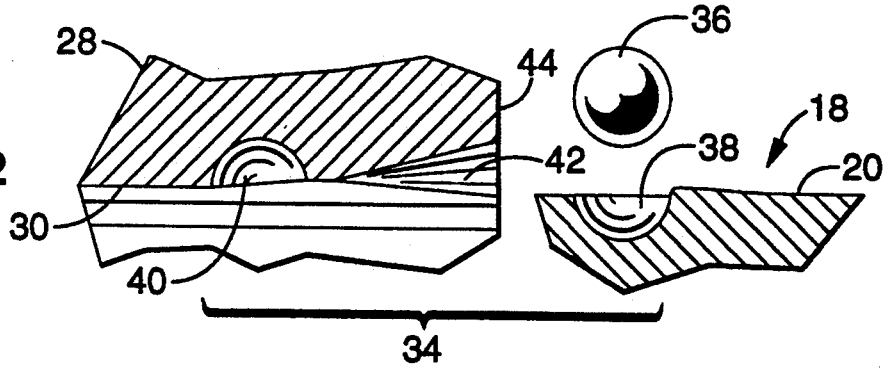
FIG. 2 is an exploded diagrammatic view of the coupling means employed in the apparatus shown in FIG. 1.
Figure 3:
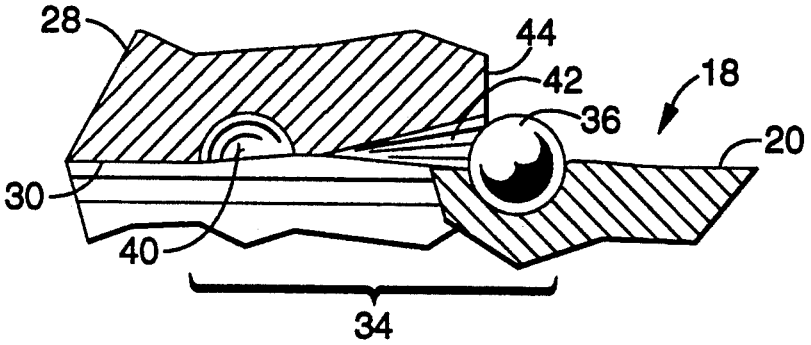
FIG. 3 is a diagrammatic view of the coupling means shown in FIG. 2 aligned for engaging the crown to the bit shank and showing a retainer ball seated in the bit shank.

Referring also to FIG. 2 and FIG. 3, the preferred means for detachably coupling second end 18 of bit shank 12 to crown 28, can be clearly seen. Coupling means 34 preferably includes a plurality of retainer balls 36, a plurality of shank sockets 38, a plurality of crown sockets 40, and a plurality of ball ramps 42.

Retainer balls 36 are preferably made from a deformable material. Regarding the preferred composition of retainer balls 36, it has been found that polyurethane provides superior deformability, resiliency in returning to shape, and superior wear characteristics in the face of the extreme pressures and vibrations caused by the demands of earth boring.

Figure 4:
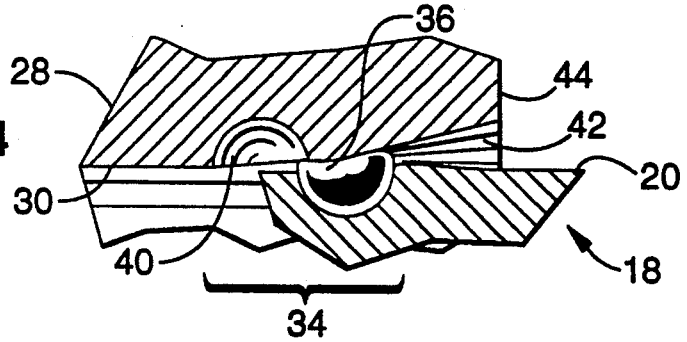
FIG. 4 is a diagrammatic view of the coupling means shown in FIG. 2 showing a retainer ball deforming against the inside surface of the crown.
Figure 5:
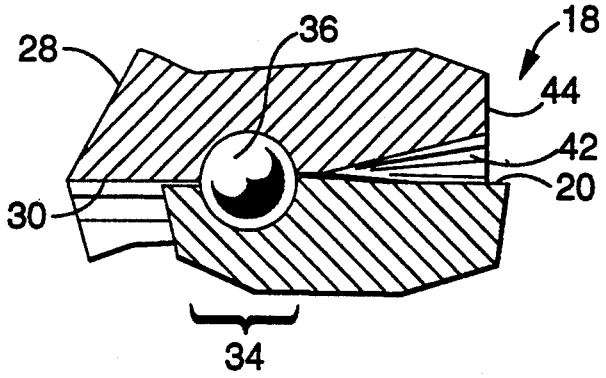
FIG. 5 is a diagrammatic view of the coupling means of FIG. 2 following engagement of the crown to the bit shank showing the retainer ball fully seated in the crown and the bit shank.

Referring also to FIG. 4 and FIG. 5 the deformable quality of retainer balls 36 is more clearly illustrated. Upon engagement of the exterior surface 20 of second end 18 of bit shank 12 with inside surface 30 of crown 28, retainer balls 36 deform to accommodate the resulting close fit.

Referring again to FIG. 1, FIG. 2 and FIG. 3 it can be seen that retainer balls 36 seat in shank sockets 38 which are preferably placed into the exterior surface 20 of second end 18 of bit shank 12. Shank sockets 38 preferably have an oblong shape for accommodating any deformations in shape which retainer balls 36 may undergo while deforming to couple with crown 28. Shank sockets 38 are of a slightly narrower width than retainer balls 36 for holding retainer balls 36 within the confines of shank sockets 38.

Referring to FIG. 1, FIG. 4, FIG. 5 and FIG. 6, crown 28 preferably has crown sockets 40 placed into its inside surface 30. Directly adjacent to crown sockets 40 are ball ramps 42 which are preferably triangular in shape and serve to gradually deform retainer balls 36 upon sliding crown 28 onto second end 18 of bit shank 12. Also preferably, each ball recess 40 is positioned adjacent to a single, corresponding ball ramp 42. The widest portion of ball ramps 42 are preferably placed near rear edge 44 of inside surface 30 of crown 28 to allow for retainer balls 36 to increasingly deform as they progress along ball ramps 42. This gradual deformation allows retainer balls 36 to attain a shape which is conducive for the easy coupling of crown 28 upon bit shank 12. Upon crown 28 becoming fully engaged upon bit shank 12, retainer balls 36 seat fully into shank sockets 38 and crown sockets 40, and regain their natural shape.

Exterior surface 20 of second end 18 of bit shank 12 as well as inside surface 30 of crown 28 are preferably substantially circular in shape. Exterior surface 20 of second end 18 is also preferably of a reduced circumference capable of accommodating the larger circumference of inside surface 30 of crown 28. The preferred design of coupling means 34 and the differing circumferences of inside surface 30 and exterior surface 20 of second end 18, create a firm, but loose fit. Upon coupling second end 18 of bit shank 12 with crown 28, sufficient air space between the exterior surface 20 and inside surface 30 of crown 28 continues to exist. The firm, but loose fit achieved by the loose crown underreamer apparatus 10 reduces the occurrence of friction welding.

Figure 7:
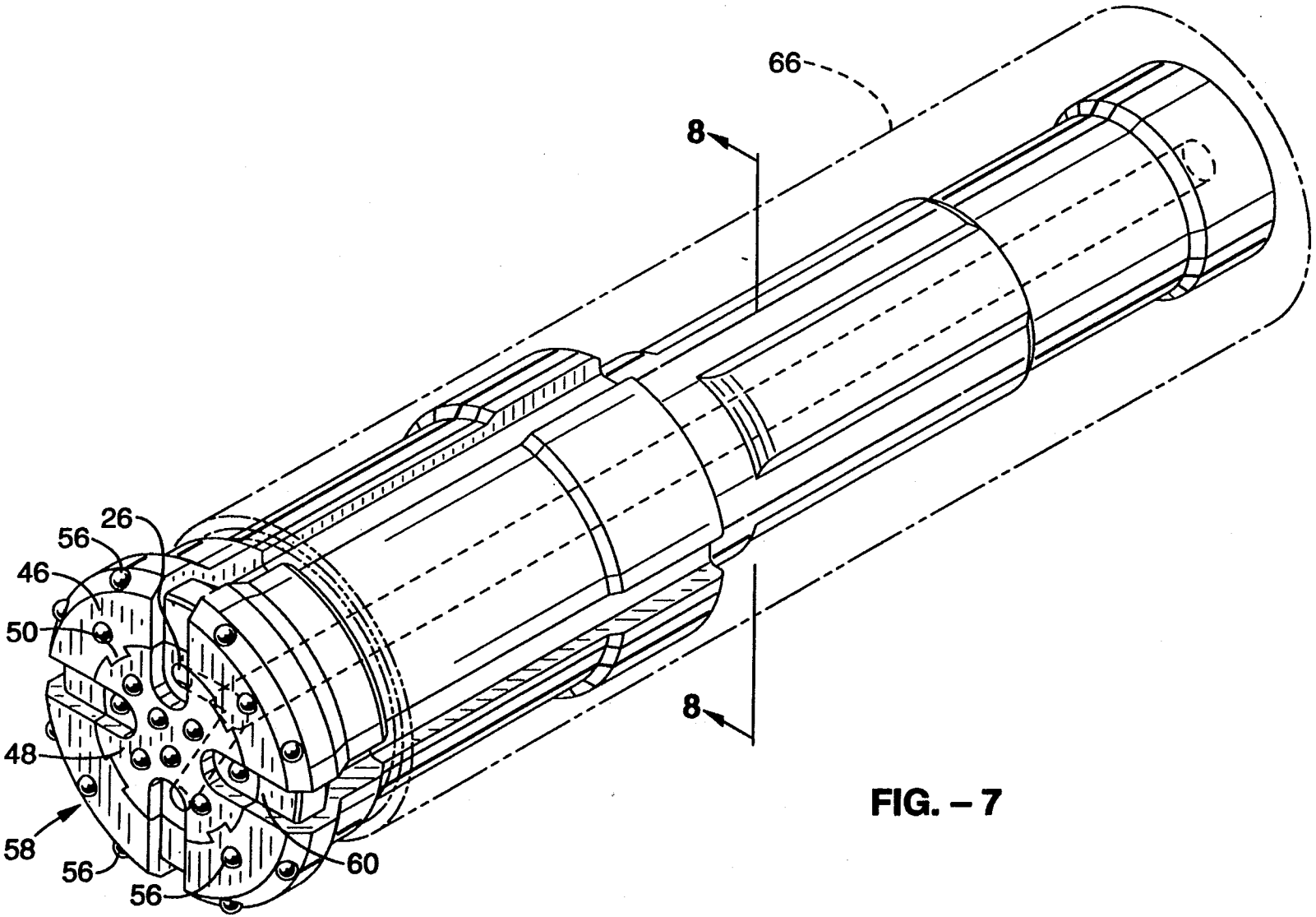
FIG. 7 is an assembled perspective view of the present invention inserted in a section of drill casing shown in phantom.

Referring to FIG. 1, FIG. 7 and FIG. 8, the preferred relation of bit shank 12 to crown 28 can be more closely examined. In FIG. 1, bottom surface 46 of crown 28 and bottom surface 48 of second end 18 of bit shank 12 can be seen, uncoupled from each other. In FIG. 8, bit shank 12 is shown coupled to crown 28. Splines 50 on crown 28 mate with slots 52 on bit shank 12, thus providing a guide means for allowing bit shank 12 to drop into the proper position for coupling means 34 to engage and lock crown 28 in place.

In the preferred embodiment, crown 28 has a cavity 54 extending coaxially into and through crown 28, cavity 54 further being bounded by inside surface 30. On bottom surface 46 of crown 28 are a plurality of cutting buttons 56 which provide a cutting means for cutting into earth and rock. Cutting buttons 56 are preferably composed of different grades of carbide or industrial diamond for cutting through hard rock surfaces. Likewise in the preferred embodiment, the bottom surface 48 of second end 18 of bit shank 12 has cutting buttons 56 coupled thereto. Upon sliding crown 28 onto second end 18 of bit shank 12, the respective bottom surfaces 46 and 48 of crown 28 and bit shank 12, respectively, align to form cutting surface 58.

The formation of cutting surface 58 also results in the formation of a plurality of air channels 60 which communicate with air shaft branch openings 26 of bit shank 12, discussed previously. Air exhaust from a drill hammer exits from air shaft branch openings 26 and blows sideways out air channels 60, thereby clearing rock and earth debris from the face of cutting surface 58.

Figure 9:
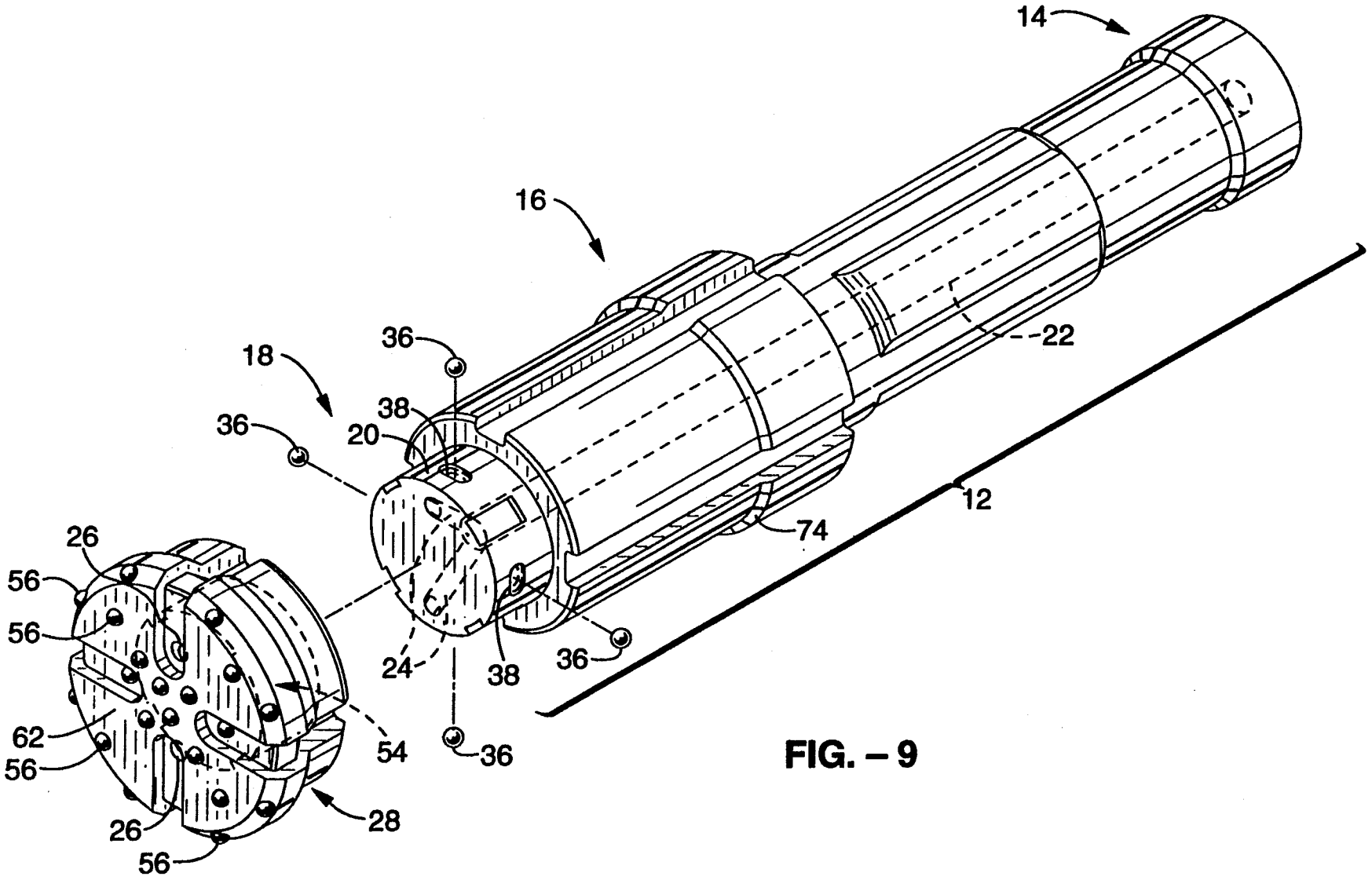
FIG. 9 is an exploded perspective view of an alternate embodiment of the present invention employing a unitary cutting surface.

In an alternate embodiment shown in FIG. 9, where like reference numerals indicate like parts in relation to the preferred embodiment, cutting surface 58 need not be formed by the mating of bottom surfaces 46 and 48 of crown 28 and bit shank 12, respectively, wherein crown 28 has a cavity 54 completely penetrating its bottom surface 46. Instead, in the alternative embodiment, the bottom of crown 28 may be a completely solid (save for air shaft branch openings 26) unitary cutting surface 62. In this embodiment, crown 28 would couple as a solid end cap to second end 18 of bit shank 12 and operate to perform all cutting functions. Also, whereas in the preferred embodiment, cavity 54 completely penetrated crown 28, here in the alternative embodiment, cavity 54 (shown in phantom) fails to completely penetrate crown 28.

Additionally, the present invention is intended to encompass all other embodiments wherein crown 28 is coupled to second end 18 of bit shank 12 using the coupling means 34, previously described. For example, an embodiment wherein crown 28 has a shaft extending upward from crown 28 which couples with a central cavity disposed in the bottom of second end 18 of bit shank 12 is within the contemplation of this invention. In such an embodiment, coupling means 34 would be disposed between the shaft on crown 28 and the cavity placed in second end 18 of bit shank 12. Also, there are no limits imposed on the placement of shank sockets 38, crown sockets 40 and ball ramps 42. For example, the invention could be practiced by placing shank sockets 38 and retainer balls 36 into inside surface 30 of crown 28 and crown sockets 40, along with ball ramps 42, could be placed upon the exterior surface 20 of second end 18 of bit shank 12.

While the coupling features of the present invention are important to the utility of the loose crown underreamer apparatus 10, equally important with regard to utility is the ease with which crown 28 of the present invention can be uncoupled from the bit shank 12.

Referring to FIG. 1, FIG. 7 and FIG. 8, the uncoupling procedure for crown 28 can be more clearly illustrated. A drive shoe 64 provides a rigid surface inside of a drill casing 66 upon which the bit shank 12 can apply significant downward force, thus carrying the entire drill casing 66 ever downward. Drive shoe 64 is typically a section of pipe having an upper section 68 with a slightly smaller circumference than drill casing 66 and a lower section 70 having a circumference equivalent to the circumference of drill casing 66. Upper section 68 is of a circumference which allows drive shoe 64 to be driven into drill casing 66 for a snug fit. The top of upper section 68 serves as a ledge 72 for bit shank 12 to rest upon. Bit shank 12 typically has a corresponding bevel 74 machined into its surface for resting upon ledge 72 of drive shoe 64. In this way, ledge 72 of drive shoe 64 provides a surface for which bit shank 12 can apply a downward force and take drill casing 66 to greater depths during a boring operation. To insure that drive shoe 64 does not disengage from drill casing 66, drive shoe 64 may be welded to drill casing 66 at gap 76.

Referring still to FIG. 7 and FIG. 8 and additionally referring to FIG. 1, FIG. 3, FIG. 4 and FIG. 5, the method for detaching crown 28 from second end 18 of bit shank 12 can be illustrated. The top portion of crown 28 preferably has an outside surface 32 with a minimum circumference equivalent to or larger than the circumference of drill casing 66 in which bit shank 12 is enclosed. In this way, when bit shank 12 is backed out of drill casing 66 and lifted therefrom, the top of crown 28 contacts the lower section 70 of drive shoe 64 and stops. As lifting pressure upon bit shank 12 is continued, an amount of applied force is reached where coupling means 34 disengages, and crown 28 is left behind, below drive shoe 64, while bit shank 12 and the remainder of the boring apparatus which includes the drill hammer, is lifted from the bore hole.

During normal operation, prior to beginning a bore hole, a drilling crew will lower the drill hammer and bit shank 12 into the first section of drill casing 66. Bevel 74 on bit shank 12 will stop against corresponding ledge 72 on drive shoe 64, and upon stopping, second end 18 of bit shank 12 will protrude below drive shoe 64 such that crown 28 can be coupled thereupon. Subsequently, the boring operation can begin and the hole can be started.

As the boring apparatus drives deeper, sections of drill casing 66 are added by the drilling crew to maintain the structural integrity of the bore hole. If the boring apparatus needs to be removed at any time during the boring operation, bit shank 12 can be uncoupled from crown 28 by lifting the boring apparatus upward as discussed previously. Subsequently, should the drilling crew desire to re-couple bit shank 12 of the boring apparatus, the mating of splines 50 on crown 28 with slots 52 on second end 18 of bit shank 12, provides a reliable way for a drilling crew to determine whether crown 28 is coupled to the second end 18 of bit shank 12. The drilling crew merely has to lower the drilling apparatus into the bore hole until second end 18 of bit shank 12 bottoms out upon the surface of crown 28. Upon bottoming out, the drill crew merely has to rotate the boring apparatus until splines 50 on crown 28 align with slots 52 on second end 18 of bit shank 12. Once alignment occurs, the entire boring apparatus will drop several inches until coupling means 34 engages. This final drop of several inches signals to the drilling crew that crown 28 has locked in place and the earth boring operation can begin again.

Accordingly, it will be seen that this invention provides a boring apparatus which employs an improved crown 28 which is detachably coupled to second end 18 of bit shank 12. The loose coupling means 34 is preferably represented by a plurality of retainer balls 36 disposed in shank sockets 38 which couple to crown sockets 40 disposed in crown 28. The use of loose coupling means 34 helps avoid the occurrence of friction welds which are common to boring operations. The loose coupling of crown 28 allows for the remainder of the boring apparatus, namely bit shank 12 and the drill hammer to be removed and re-coupled at will. Should crown 28 break or become stuck during a boring operation, this device specifically allows for easy salvaging of the very expensive bit shank 12 and drill hammer portions of the boring apparatus.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A loose crown underreamer apparatus, comprising:

(a) a bit shank, said bit shank having first and second ends;

(b) a crown; and (c) coupling means for detachably coupling said bit shank to said crown, said coupling means including a plurality of resiliently deformable balls, a plurality of shank sockets for retaining said balls and a plurality of crown sockets for receiving said balls upon coupling said crown to said bit shank.

2. A loose crown underreamer apparatus as recited in claim 1, further comprising air shaft means for passing air through said bit shank and said crown, said air shaft means axially disposed between said first and second ends of said bit shank, said air shaft means dividing into a plurality of air shaft branches, said plurality of air shaft branches terminating at a corresponding plurality of air shaft branch openings.

3. A loose crown underreamer apparatus as recited in claim 2, wherein said plurality of air shaft branch openings terminate in said second end of said bit shank, said air shaft branch openings further communicating with a plurality of air channels.

4. A loose crown underreamer apparatus as recited in claim 3, wherein said crown has a cavity bounded by an inside surface and said second end of said bit shank has an exterior surface, said coupling means being disposed between said inside surface of said crown and said exterior surface of said bit shank.

5. A loose crown underreamer apparatus as recited in claim 4, wherein said shank sockets and said resiliently deformable retainer balls are disposed within said second end of said bit shank, said retainer balls coupling with said crown sockets disposed within said inside surface of said crown.

6. A loose crown underreamer apparatus as recited in claim 5, wherein said coupling means further comprises a plurality of ball ramps, each said ball ramps positioned adjacent to a corresponding one of said crown sockets.

7. A loose crown underreamer apparatus as recited in claim 6, wherein said crown has a plurality of splines, said splines coupling with a corresponding plurality of slots placed into said second end of said bit shank.

8. An apparatus for boring holes, comprising:

(a) a bit shank, said bit shank having first and second ends, said second end of said bit shank having an exterior surface;

(b) a crown, said crown having a cavity extending coaxially into said crown, said cavity having an inside surface;

(c) coupling means for detachably coupling said crown to said second end of said bit shank, said coupling means including a plurality of resiliently deformable balls, a plurality of shank sockets for retaining said balls and a plurality of crown sockets for receiving said balls;

(d) said second end of said bit shank extending into said cavity, said coupling means disposed between said exterior surface of said bit shank and said inside surface of said cavity.

9. An apparatus for boring holes as recited in claim 8, further comprising air shaft means for passing air through said bit shank and said crown, said air shaft means axially disposed between said first and second ends of said bit shank, said air shaft means dividing into a plurality of air shaft branches, said plurality of air shaft branches terminating at a corresponding plurality of air shaft branch openings.

10. An apparatus for boring holes as recited in claim 9, wherein said plurality of air shaft branch openings terminate in said second end of said bit shank, said air shaft branch openings further communicating with a plurality of air channels.

11. An apparatus for boring holes as recited in claim 10, wherein said shank sockets and said resiliently deformable retainer balls are disposed within said second end of said bit shank, said retainer balls coupling with said crown sockets disposed within said inside surface of said crown.

12. An apparatus for boring holes as recited in claim 11, wherein said coupling means further comprises a plurality of ball ramps, each said ball ramps positioned adjacent to a corresponding one of said crown sockets.

13. An apparatus for boring holes as recited in claim 12, wherein said crown has a plurality of splines, said splines coupling with a corresponding plurality of slots placed into said second end of said bit shank.

14. A crown bit apparatus, comprising:

(a) a bit shank, said bit shank having first and second ends, said first end having means for coupling to a drill hammer, said second end having an exterior surface, said exterior surface having a plurality of slots;

(b) a crown, said crown having a cavity extending coaxially into said crown, said cavity having an inside surface, said inside surface having a plurality of splines placed thereon, said plurality of splines coupling with said plurality of slots upon extending said second end of said bit shank into said cavity;

(c) coupling means for detachably coupling said second end of said bit shank to said crown, said coupling means including a plurality of resiliently deformable retainer balls disposed within said second end of said bit shank, said retainer balls coupling to a corresponding plurality of crown sockets disposed within said inside surface of said crown; and (d) cutting means for cutting, said cutting means coupled to said crown.

15. A crown bit apparatus as recited in claim 14, further comprising air shaft means for passing air through said bit shank and said crown, said air shaft means axially disposed between said first and second ends of said bit shank, said air shaft means dividing into a plurality of air shaft branches, said plurality of air shaft branches terminating at a corresponding plurality of air shaft branch openings.

16. A crown bit apparatus as recited in claim 15 wherein said crown and said second end of said bit shank have a bottom surface, said cavity completely penetrating said bottom surface of said crown to form a hole through said crown, said bottom surface of said bit shank extending through said hole in said crown and aligning with said bottom surface of said crown, said alignment of said bottom surfaces of said crown and said second end of said bit shank forming a cutting surface, said cutting means coupled to said cutting surface.

* * * * *